US010299048B2

(12) United States Patent
van Gilst

(10) Patent No.: US 10,299,048 B2
(45) Date of Patent: May 21, 2019

(54) RECEIVER UNIT WITH ENHANCED FREQUENCY RESPONSE

(71) Applicant: Sonion Nederland B.V., Hoofddorp (NL)

(72) Inventor: Koen van Gilst, Uithoorn (NL)

(73) Assignee: SONION NEDERLAND B.V., Hoofddorp (NL)

( * ) Notice: Subject to any disclaimer, the term of this patent is extended or adjusted under 35 U.S.C. 154(b) by 0 days.

(21) Appl. No.: 15/240,886

(22) Filed: Aug. 18, 2016

(65) Prior Publication Data

US 2017/0055086 A1 Feb. 23, 2017

(30) Foreign Application Priority Data

Aug. 19, 2015 (EP) ..... 15181573

(51) Int. Cl.

| | |
|---|---|
| ***H04R 1/24*** | (2006.01) |
| ***H04R 11/02*** | (2006.01) |
| ***H04R 25/00*** | (2006.01) |

(52) U.S. Cl.

CPC ..... *H04R 25/48* (2013.01); *H04R 1/24* (2013.01); *H04R 11/02* (2013.01); *H04R 25/502* (2013.01); *H04R 25/604* (2013.01)

(58) Field of Classification Search

CPC ..... H04R 25/48; H04R 1/24; H04R 11/02; H04R 25/502; H04R 25/604

USPC ..... 381/324

See application file for complete search history.

(56) References Cited

U.S. PATENT DOCUMENTS

| | | | |
|---|---|---|---|
| 6,788,796 | B1 | 9/2004 | Miles et al. |
| 6,831,577 | B1 | 12/2004 | Furst |
| 6,853,290 | B2 | 2/2005 | Jorgensen et al. |
| 6,859,542 | B2 | 2/2005 | Johannsen et al. |
| 6,888,408 | B2 | 5/2005 | Furst et al. |
| 6,914,992 | B1 | 7/2005 | van Halteren et al. |
| 6,919,519 | B2 | 7/2005 | Ravnkilde et al. |
| 6,930,259 | B1 | 8/2005 | Jorgensen et al. |
| 6,943,308 | B2 | 9/2005 | Ravnkilde et al. |
| 6,974,921 | B2 | 12/2005 | Jorgensen et al. |
| 7,008,271 | B2 | 3/2006 | Jorgensen |
| 7,012,200 | B2 | 3/2006 | Moller |
| 7,062,058 | B2 | 6/2006 | Steeman et al. |

(Continued)

FOREIGN PATENT DOCUMENTS

| | | |
|---|---|---|
| EP | 1895811 A2 | 3/2008 |
| EP | 2744222 A2 | 6/2014 |

(Continued)

OTHER PUBLICATIONS

Partial European Search Report for Application No. EP 15 18 1573, date of completion Feb. 1, 2016 (2 pages).

*Primary Examiner* — Sean H Nguyen
(74) *Attorney, Agent, or Firm* — Nixon Peabody LLP

(57) ABSTRACT

The present invention relates to a receiver unit comprising a plurality of moveable membranes, a motor assembly being adapted to drive a first moveable membrane and one or more successive moveable membranes in accordance with an incoming electrical drive signal, wherein the first and at least one of the successive moveable membranes have different frequency responses in order to enhance the frequency response of the receiver unit. The present invention further relates to a hearing aid instrument comprising the receiver unit.

15 Claims, 4 Drawing Sheets

(56) References Cited

U.S. PATENT DOCUMENTS 7,062,063 B2 6/2006 Hansen et al.
7,072,482 B2 7/2006 Van Doorn et al.
7,088,839 B2 8/2006 Geschiere et al.
7,110,560 B2 9/2006 Stenberg
7,136,496 B2 11/2006 van Halteren et al.
7,142,682 B2 11/2006 Mullenborn et al.
7,181,035 B2 2/2007 van Halteren et al.
7,190,803 B2 3/2007 van Halteren
7,206,428 B2 4/2007 Geschiere et al.
7,221,767 B2 5/2007 Mullenborn et al.
7,221,769 B1 5/2007 Jorgensen
7,227,968 B2 6/2007 van Heltren et al.
7,239,714 B2 7/2007 de Blok et al.
7,245,734 B2 7/2007 Niederdraenk
7,254,248 B2 8/2007 Johannsen et al.
7,286,680 B2 10/2007 Steeman et al.
7,292,700 B1 11/2007 Engbert et al.
7,292,876 B2 11/2007 Bosh et al.
7,336,794 B2 2/2008 Furst et al.
7,376,240 B2 5/2008 Hansen et al.
7,403,630 B2 7/2008 Jorgensen et al.
7,415,121 B2 8/2008 Mögelin et al.
7,425,196 B2 9/2008 Jorgensen et al.
7,460,681 B2 12/2008 Geschiere et al.
7,466,835 B2 12/2008 Stenberg et al.
7,492,919 B2 2/2009 Engbert et al.
7,548,626 B2 6/2009 Stenberg et al.
7,657,048 B2 2/2010 van Halteren et al.
7,684,575 B2 3/2010 van Halteren et al.
7,706,561 B2 4/2010 Wilmink et al.
7,715,583 B2 5/2010 Van Halteren et al.
7,728,237 B2 6/2010 Pedersen et al.
7,809,151 B2 10/2010 Van Halteren et al.
7,822,218 B2 10/2010 Van Halteren
7,899,203 B2 3/2011 Van Halteren et al.
7,912,240 B2 3/2011 Madaffari et al.
7,946,890 B1 5/2011 Bondo et al.
7,953,241 B2 5/2011 Jorgensen et al.
7,961,899 B2 6/2011 Van Halteren et al.
7,970,161 B2 6/2011 van Halteren
8,098,854 B2 1/2012 van Halteren et al.
8,101,876 B2 1/2012 Andreasen et al.
8,103,039 B2 1/2012 van Halteren et al.
8,160,290 B2 4/2012 Jorgensen et al.
8,170,249 B2 5/2012 Halteren
8,189,804 B2 5/2012 Hruza
8,189,820 B2 5/2012 Wang
8,189,841 B2 * 5/2012 Litovsky ..... H04R 1/2834 381/182
8,223,996 B2 7/2012 Beekman et al.
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,280,082 B2 10/2012 van Halteren et al.
8,284,966 B2 10/2012 Wilk et al.
8,313,336 B2 11/2012 Bondo et al.
8,315,422 B2 11/2012 van Halteren et al.
8,331,595 B2 12/2012 van Halteren
8,369,552 B2 2/2013 Engbert et al.
8,379,899 B2 2/2013 van Halteren et al.
8,509,468 B2 8/2013 van Halteren et al.
8,526,651 B2 9/2013 Lafort et al.
8,526,652 B2 9/2013 Ambrose et al.
2001/0012375 A1 * 8/2001 Miller ..... H04R 11/04 381/418
2005/0111673 A1 * 5/2005 Rosen ..... B60R 11/0217 381/89
2006/0153418 A1 7/2006 Van Halteren
2008/0267431 A1 * 10/2008 Leidl ..... H04R 1/2838 381/173
2009/0310807 A1 * 12/2009 van Halteren ..... H04R 25/60 381/328
2010/0080406 A1 * 4/2010 Yang ..... H04R 9/025 381/186
2011/0182453 A1 7/2011 van Hal et al.
2011/0189880 A1 8/2011 Bondo et al.
2011/0299708 A1 12/2011 Bondo et al.
2011/0299712 A1 12/2011 Bondo et al.
2011/0311069 A1 12/2011 Ambrose et al.
2012/0014548 A1 1/2012 van Halteren
2012/0027245 A1 2/2012 van Halteren et al.
2012/0140966 A1 6/2012 Mocking et al.
2012/0155683 A1 6/2012 van Halteren
2012/0155694 A1 6/2012 Reeuwijk et al.
2012/0255805 A1 10/2012 van Halteren et al.
2013/0028451 A1 1/2013 de Roo
2013/0136284 A1 5/2013 van Hal et al.
2013/0142370 A1 6/2013 Engbert et al.
2013/0163799 A1 6/2013 Van Halteren
2013/0195295 A1 8/2013 van Halteren et al.
2014/0140551 A1 * 5/2014 Ramstein ..... H04R 17/005 381/182
2015/0036868 A1 * 2/2015 Unruh ..... H04R 7/08 381/398
2015/0245141 A1 * 8/2015 van Halteren ..... H04R 7/02 381/398
2016/0255433 A1 * 9/2016 Grinker ..... H04R 1/1016 381/380

FOREIGN PATENT DOCUMENTS

WO WO 2004/103019 A2 11/2004
WO WO 2013/023414 A1 2/2013

* cited by examiner

RECEIVER UNIT WITH ENHANCED FREQUENCY RESPONSE

CROSS REFERENCE TO RELATED APPLICATIONS

This application claims the benefit of European Patent Application Serial No. EP 15181573.5, filed Aug. 19, 2015, and titled "Receiver Unit With Enhanced Frequency Response," which is incorporated herein by reference in its entirety.

FIELD OF THE INVENTION

The present invention relates to a receiver unit having an enhanced frequency response. In particular, the present invention relates to a balanced armature type receiver unit having a membrane arrangement comprising a plurality of membranes in order to enhance the frequency response in selected frequency ranges. The enhanced frequency response is provided since each membrane has its own and unique frequency response that adds to the total output signal of the receiver unit.

BACKGROUND OF THE INVENTION

The frequency response of miniature receiver units is often limited. This applies in principle for all frequency responses, including both the high- and low-frequency response.

As an example, it is well-known that due to the limited membrane area as well as the limited stroke length the low-frequency response from miniature receiver units in open fittings is often rather weak. In order to improve and thereby increase this low-frequency response either the membrane area or the stroke length, or preferably both, must be increased.

Hearing aid receiver units are however often used in hearing aid instruments where the available space is very limited. An example of such a hearing aid instrument is the one being denoted receiver-in-canal (RIC) where the hearing aid receiver is positioned inside the ear canal of the user of the hearing aid instrument. Obviously, by positioning the hearing aid receiver inside the ear canal of the user puts high demands on the allowable outer dimensions of the receiver.

It may be seen as an object of embodiments of the present invention to provide a receiver unit having an enhanced frequency response.

It may be seen as a further object of embodiments of the present invention to provide a receiver unit having an enhanced low-frequency response without increasing the outer dimensions of the receiver unit significantly.

It may be seen as an even further object of embodiments of the present invention to provide an armature type receiver unit having an enhanced low-frequency response without increasing the outer dimensions of the receiver unit significantly.

DESCRIPTION OF THE INVENTION

The above-mentioned objects are complied with by providing, in a first aspect, a receiver unit comprising (a) a plurality of moveable membranes, (b) a motor assembly being adapted to drive a first moveable membrane and one or more successive moveable membranes in accordance with an incoming electrical drive signal, and wherein the first and at least one of the successive moveable membranes have different frequency responses.

Thus, the present invention relates to a receiver unit being able to generate audio sound in response to an incoming electrical signal.

In the following a receiver unit comprising a first movable membrane and a single successive membrane will be discloses. It should be noted, however, that a plurality of successive moveable membranes may be provided instead.

The first moveable membrane in combination with the successive moveable membrane provides that an enhanced frequency response may be achieved. In the present context the term "enhanced frequency response" is here to be understood as a modified frequency response compared to a single membrane receiver unit. An enhanced frequency response may, for example, be provided by modifying the high- and/or low-frequency response of the receiver unit. One way to provide this modified frequency response may involve that the first and the successive membranes are different, such as different in sizes, different displacement, different materials etc.

The receiver unit of the present invention is of particular relevance in connection with applications where only a limited amount of space is available. Such applications may include RIC type hearing aid instruments.

The motor assembly may in principle be any kind of suitable motor assembly. Preferably, the motor assembly comprises a moving armature type motor, such as a balanced moving armature type motor.

In order to drive and thereby move the first and the successive membranes, the moving armature of the motor assembly may be mechanically connected to the first and the successive moveable membranes. Thus, a movement or displacement of the moving armature causes a movement of the first and the successive membranes.

In an embodiment of the present invention the moving armature may be mechanically connected to the first moveable membrane via a substantially stiff connection. Such mechanically stiff connection may involve a stiff metal drive pin or rod. The first moveable membrane may in this embodiment comprise a resonating element to which the mechanically stiff connection is secured.

In addition, the moving armature may be mechanically connected to the successive moveable membrane via another resonating element comprised within the mechanical connection between the moving armature and the successive moveable membrane.

Resonating elements may involve a string element, such as an extension spring.

The respective mechanical connections from the first and successive membranes may be secured to the moving armature at a distal end thereof. Here, the distal end of the moving armature should be understood as the free end of the moving armature, i.e. opposite to the end at which the moving armature is hinged or by other means fixated. The moving armature may take the shape of a substantially linear structure which may be hinged at one end and free to more at the other end. Alternatively, the moving armature may be formed as a U-shaped armature structure where one end of one of the legs may be free to move.

In order to adapt the frequency response the successive moveable membrane may be adapted to resonate at another frequency compared to the first moveable membrane. The mass of the successive movable membrane itself as well as the compliance and resistance of the suspension member of the successive movable membrane may ensure that such different resonance frequency is provided. Also, the resonating element positioned in the mechanical connection between the moving armature and the successive movable membrane may course that a different resonance frequency is provided.

In the following, the terms back volume and front volume are defined as follows: (i) a back volume is located on that side of a membrane where the driving force is applied, i.e. typically on that side of the membrane where the motor assembly is positioned, and (ii) a front volume is located on the free side of a membrane, i.e. the side where the driving force is not applied.

Both front and back volumes, as well as combinations thereof, may have one or more acoustical openings thereby forming open front/back volumes. In the present context, an acoustical opening is an opening to the outside of the receiver.

Within the receiver unit of the present invention at least one back volume may be associated with each of the first and successive moveable membranes. Each of these back volumes may comprise an acoustical opening, said acoustical openings being acoustically connected to a sound outlet opening of the receiver unit. Thus, prior to leaving the receiver unit pressurized air from the two back volumes are mixed in a combined back volume which is acoustically connected to the sound outlet opening of the receiver unit. The motor assembly may be positioned within the combined back volume.

Similarly, the receiver unit of the present invention may comprise at least one front volume associated with each of the first and successive moveable membranes. Each of these front volumes may comprise an acoustical opening which is acoustically connected to the sound outlet opening of the receiver unit via a combined front volume.

The audio output signal from the receiver unit may enter an acoustical filter unit. In a second aspect the present invention relates to a hearing aid instrument comprising a receiver unit according to the first aspect. The hearing aid instrument may in principle be any kind of hearing aid, such as a RIC type hearing aid instrument.

BRIEF DESCRIPTION OF THE DRAWINGS

The present invention will now be described in further details with reference to the accompanying figures, wherein.

Figure 1:
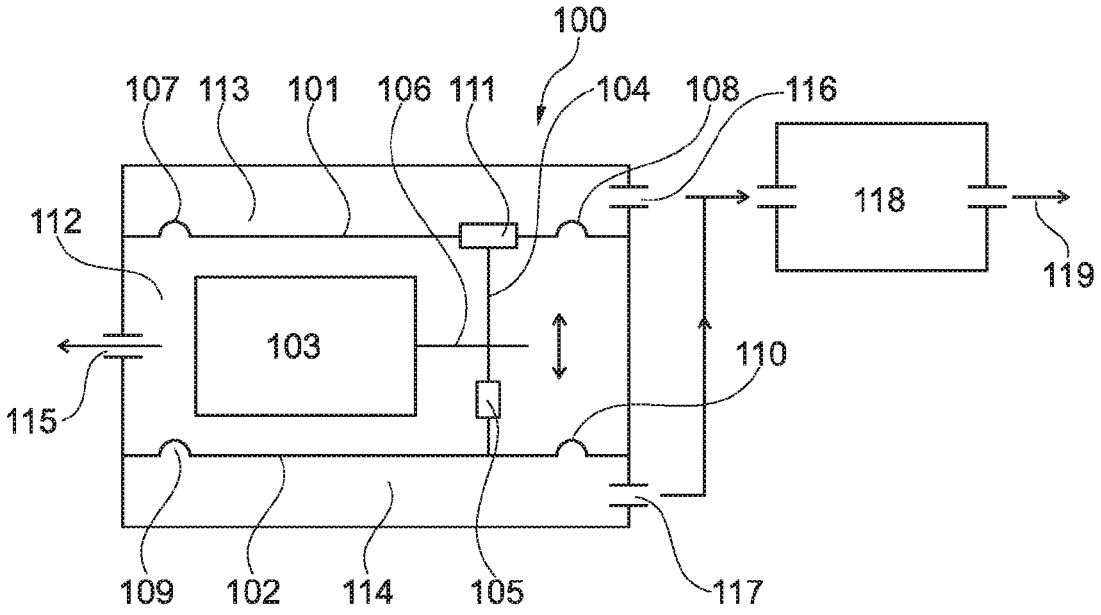
FIG. 1 shows a cross-sectional view of a receiver unit having two membranes where the sound output is taken from the back volume.

While the invention is susceptible to various modifications and alternative forms specific embodiments have been shown by way of examples in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its broadest aspect the present invention relates to a receiver unit having an enhanced frequency response. The receiver unit of the present invention should be applicable for various types of hearing aid instruments, including the MC where the available space for the receiver unit is very limited.

Referring now to FIG. 1, a balanced armature receiver unit 100 is depicted. As seen in FIG. 1 the receiver unit 100 comprises a first moveable membrane 101 and a second (successive) moveable membrane 102 where the latter is responsible for the enhanced acoustic output. The first moveable membrane 101 and second moveable membrane 102 are driven by the same motor assembly 103, which is mechanically connected to both the first moveable membrane 101 and second moveable membrane 102. The motor assembly 103 may be an armature type motor.

As illustrated in FIG. 1, a substantially stiff mechanical connection 104 is connecting the motor assembly 103 and the first membrane 101 via the resonating connection 111 which forms part of the first membrane 101. Contrary to this, a resonating mechanical connection 105 is connecting the motor assembly 103 and the second membrane 102.

The mechanical connections 104 and 105 are both secured to a distal and moveable end of the motor drive pin 106. The movements of the drive pin 106 are indicated by the arrow. In case of a moving armature type motor, the drive pin 106 will be the moving armature that is hinged at an end being opposite to the distal and moveable end. A moving armature may take different shapes, such as a linear structure or for example a U-shaped armature structure.

The resonating element 105, in combination with the mass of the second membrane 102, causes the second membrane 102 to resonate at a different frequency compared to the first membrane 101. This different frequency may either lower or higher that the resonance frequency of the first membrane.

The drive pin 106 is brought into movements by applying an audio drive signal. The audio drive signal may be of various types, such as analog signals, pulse width modulated (PWM) signals etc.

The first and second membranes 101, 102 are suspended in suspension members 107, 108 and 109, 110 respectively. As depicted in FIG. 1 the suspension members are positioned in opposite ends of the respective membranes 101, 102.

As previously stated back and front volumes are defined as follows. (1) A back volume is located on that side of a membrane where the driving force is applied, i.e. typically on that side of the membrane where the motor assembly is positioned. (2) A front volume is located on the free side of a membrane, i.e. the side where the driving force is not applied.

Still referring to FIG. 1, the receiver unit 100 comprises a combined back volume 112 and front volumes 113, 114. In receiver unit 100 depicted in FIG. 1, the sound outlet is taken from the back volume 112 via the acoustical opening 115. Other acoustical openings 116, 117 in the respective front volumes 113, 114 lead acoustical output signals to an acoustical filter unit 118 before the final signal 119 is generated.

Figure 2:
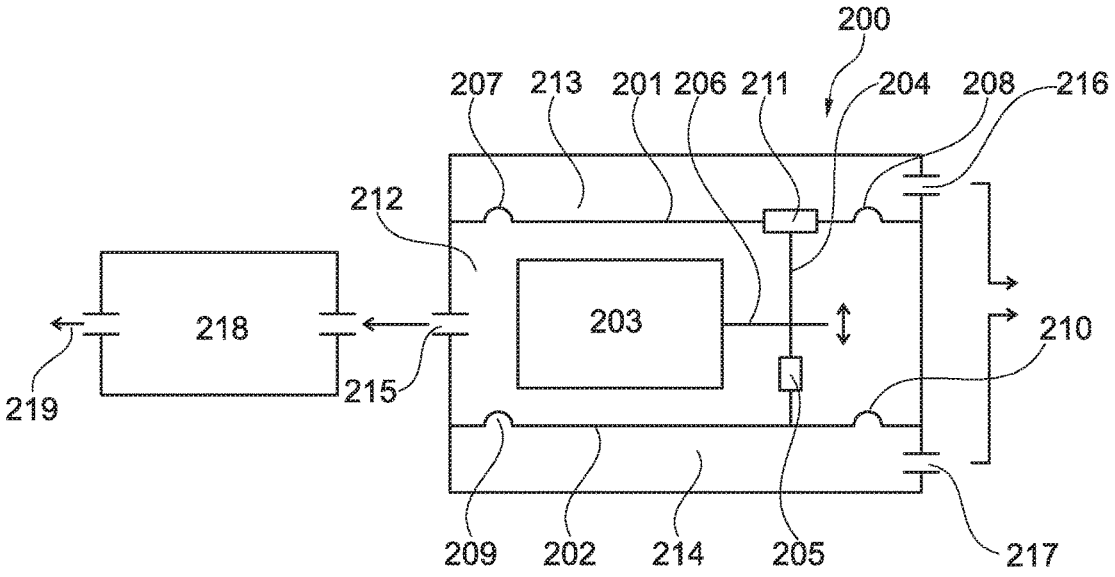
FIG. 2 shows a cross-sectional view of a receiver unit having two membranes where the sound output is taken from the front volumes.

FIG. 2 shows a receiver unit 200 identical to the one depicted in FIG. 1. Thus, FIG. 2 shows a balanced armature receiver unit 200 is depicted comprising a first moveable membrane 201 and a second moveable membrane 202 being driven by the same motor assembly 203. Again, the motor assembly 203 may be an armature type motor. A substantially stiff mechanical connection 204 is connecting the motor assembly 203 and the first membrane 201 via the resonating connection 211 which forms part of the first membrane 201. Contrary to this a resonating mechanical connection 205 connects the motor assembly 203 and the second membrane 202. The mechanical connections 204 and 205 are both secured to a distal and moveable end of the motor drive pin 206 which in case of a moving armature type motor will be the moving armature. A moving armature may take different shapes, such as a linear structure or for example a U-shaped armature structure.

The resonating element 205, in combination with the mass of the second membrane 202, causes the second membrane 202 to resonate at a different frequency compared to the first membrane 201. This different frequency may either lower or higher that the resonance frequency of the first membrane.

The drive pin 206 is brought into movements by applying an audio drive signal. The audio drive signal may be of various types, such as analog signals, pulse width modulated (PWM) signals etc. The first and second membranes 201, 202 are suspended in suspension members 207, 208 and 209, 210, respectively, which are positioned in opposite ends of the respective membranes 201, 202.

The receiver unit 200 comprises a combined back volume 212 and front volumes 213, 214. Contrary to the receiver unit 100 depicted in FIG. 1, the sound outlet is now taken from the front volumes 213, 214 via the acoustical openings 216, 217. Another acoustical opening 215 in the back volume 212 leads an acoustical output signal to an acoustical filter unit 218 before the final signal 219 is generated.

Figure 3:
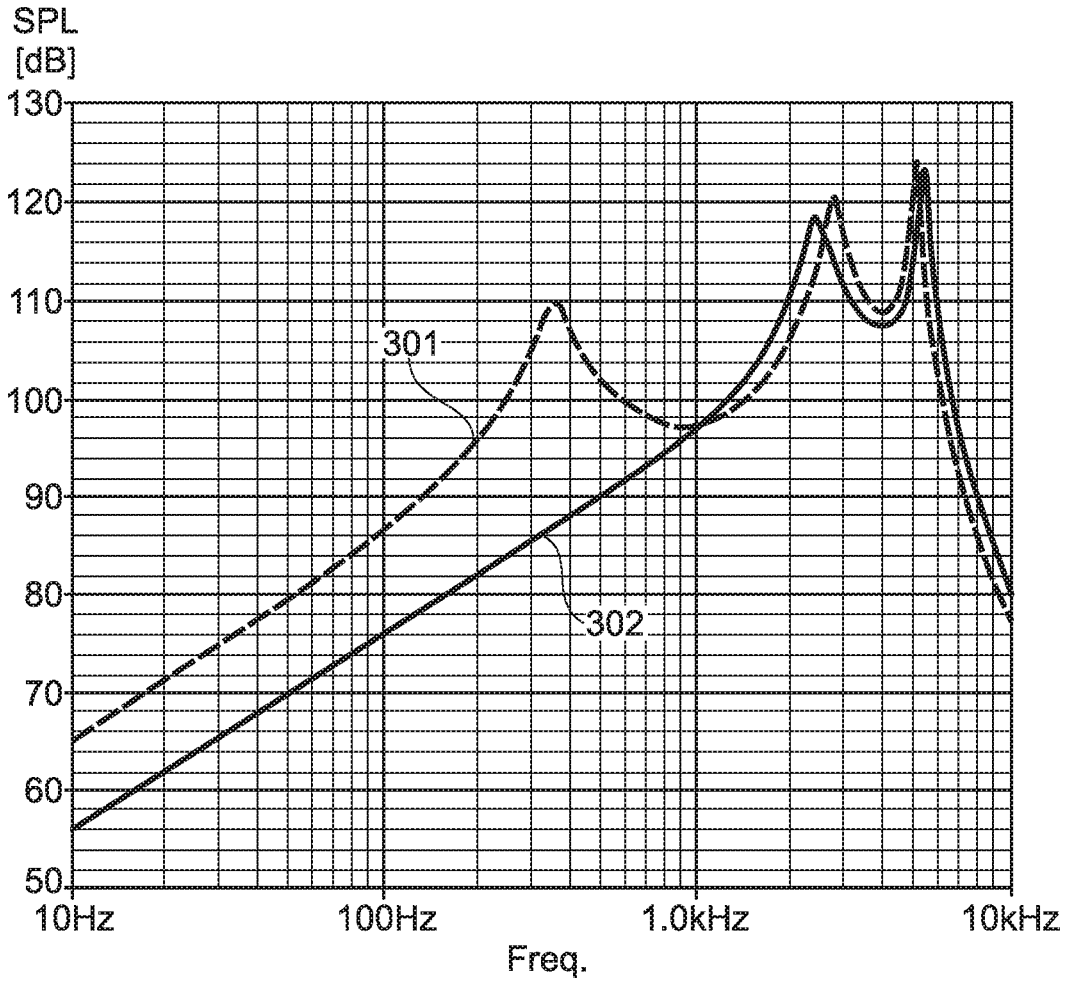
FIG. 3 shows simulated frequency response curves.
Figure 4:
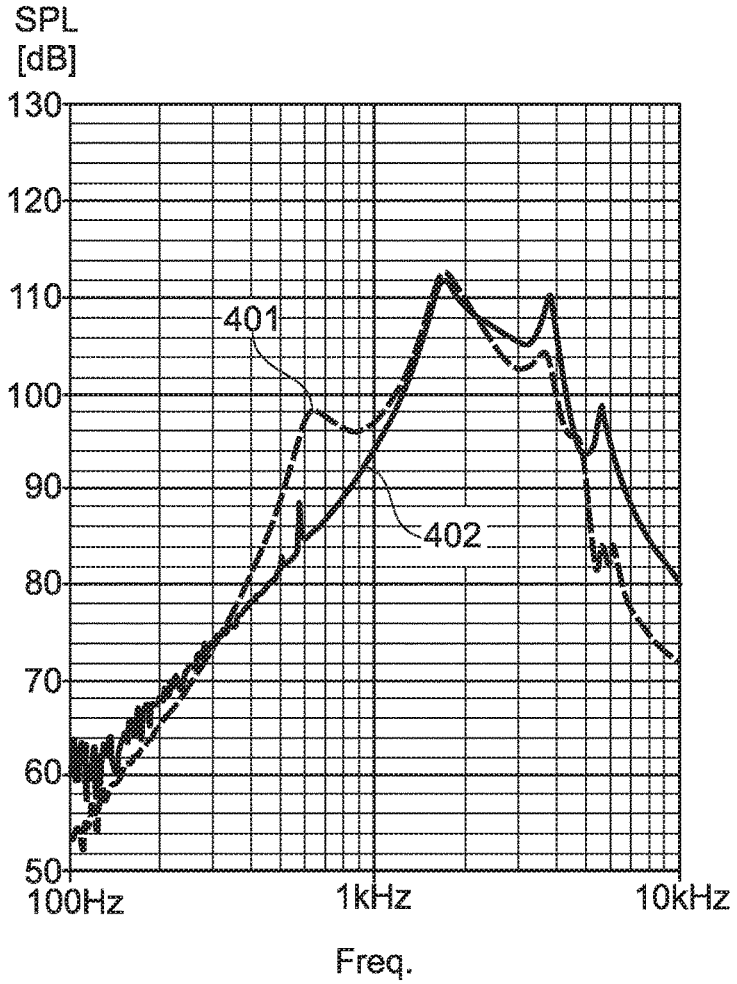
FIG. 4 shows measured frequency response curves.

FIGS. 3 and 4 show respective simulations and measurements of a receiver unit having an enhanced low-frequency response. The enhanced low-frequency responses are, for both simulations and measurements, compared to a single membrane receiver unit.

FIG. 3 shows a simulation of the sound pressure level (SPL) vs. frequency for a single membrane balanced armature receiver 302 and a dual membrane balanced armature receiver 301. As seen in FIG. 3 the dual membrane receiver provides an enhanced SPL up to around 1 kHz. Above 1 kHz the SPL for the single and dual membrane receivers become essentially comparable. As seen from FIG. 3, the in-phase behaviour of the second membrane below its resonance frequency of around 350 Hz increases the overall SPL of the balanced armature receiver by around 10 dB from 10 Hz to 150 Hz. An even further enhancement of the SPL is provided around the resonance frequency (approximately 350 Hz) of the second membrane.

FIG. 4 shows measured SPL's from a single membrane balanced armature receiver 402 and a dual membrane balanced armature receiver 401. The measured difference between single membrane 402 and dual membrane 401 receivers is not as pronounced as the simulated result presented in FIG. 3. However, the increased low-frequency SPL of the dual membrane receiver 401 is still evident in that an enhancement of up to 10 dB has been measured below the resonance frequency (around 620 Hz) of the second membrane.

The invention claimed is:

1. A receiver unit comprising:

a) a plurality of moveable membranes, b) a motor being adapted to mechanically drive each of a first moveable membrane and one or more successive moveable membranes in accordance with an incoming electrical drive signal to the motor, wherein the first and at least one of the successive moveable membranes have different frequency responses.

2. A receiver unit according to claim 1, wherein the motor comprises a moving armature type motor, such as a balanced moving armature type motor.

3. A receiver unit according to claim 2, wherein the armature type motor includes an armature driving each of the first moveable membrane and at least one of the successive moveable membranes.

4. A receiver unit according to claim 1, wherein the motor is mechanically connected to each of the first and at least one of the successive membranes via a resonating element, such as a spring.

5. A receiver unit according to claim 4, wherein the first and/or at least one of the successive membranes comprise a resonating element.

6. A receiver unit according to claim 5, wherein a mechanical connection between the motor and the first and/or at least one of the successive membranes comprise a resonating element.

7. A receiver unit according to claim 1, wherein an acoustical back volume is associated with each of the respective first and at least one of the successive moveable membranes.

8. A receiver unit according to claim 1, wherein a combined acoustical back volume is formed by a combination of two or more acoustical back volumes, and wherein the motor is positioned within said combined acoustical back volume.

9. A receiver unit according to claim 8, wherein each of the combined acoustical back volumes comprises one or more acoustical openings.

10. A receiver unit according to claim 9, wherein the one or more acoustical openings are acoustically connected to one or more acoustical filters.

11. A receiver unit according to claim 1, wherein an acoustical front volume is associated with each of the first and successive moveable membranes.

12. A receiver unit according to claim 11, wherein a combined acoustical front volume is formed by a combination of two or more acoustical front volumes.

13. A receiver unit according to claim 12, wherein each of the combined acoustical front volumes comprises one or more acoustical openings.

14. A receiver unit according to claim 13, wherein the one or more acoustical openings are acoustically connected to one or more acoustical filters.

15. A hearing aid instrument comprising a receiver unit according to claim 1.

* * * * *